US008104654B2

(12) United States Patent
Overton

(10) Patent No.: US 8,104,654 B2
(45) Date of Patent: Jan. 31, 2012

(54) BELT WITH EXPANDABLE POUCH

(75) Inventor: Kimberley Overton, Austin, TX (US)

(73) Assignee: Overton Enterprises, LLC, Austin, TX (US)

( * ) Notice: Subject to any disclaimer, the term of this patent is extended or adjusted under 35 U.S.C. 154(b) by 744 days.

(21) Appl. No.: 12/030,034

(22) Filed: Feb. 12, 2008

(65) Prior Publication Data

US 2008/0190980 A1 Aug. 14, 2008

Related U.S. Application Data

(60) Provisional application No. 60/901,815, filed on Feb. 13, 2007, provisional application No. 60/932,250, filed on May 29, 2007.

(51) Int. Cl.
*A45F 3/00* (2006.01)

(52) U.S. Cl. ..... 224/581; 224/664; 224/676

(58) Field of Classification Search ..... 224/660, 224/664, 219, 221, 222, 581, 587, 676; D3/215, D3/226

See application file for complete search history.

(56) References Cited

U.S. PATENT DOCUMENTS

| | | | | |
|---|---|---|---|---|
| D29,490 | S | 10/1898 | Varni-Gardinier | |
| 2,004,477 | A * | 6/1935 | Mather | 224/587 |
| 2,351,158 | A * | 6/1944 | Stelzer | 224/199 |
| 4,804,121 | A * | 2/1989 | Stanton et al. | 224/191 |
| 5,060,835 | A | 10/1991 | Payne | |
| 5,150,824 | A | 9/1992 | Alvarez et al. | |
| 5,170,917 | A * | 12/1992 | Tourigny | 224/221 |
| D334,471 | S | 4/1993 | Yerby et al. | |
| D343,292 | S | 1/1994 | Copeland | |
| 5,289,960 | A * | 3/1994 | Kelly et al. | 224/664 |
| 5,294,031 | A | 3/1994 | Volpei et al. | |
| 5,341,928 | A * | 8/1994 | Jones et al. | 206/315.5 |
| 5,353,975 | A | 10/1994 | Libertucci | |
| 5,395,022 | A | 3/1995 | Vandewall | |
| 5,425,719 | A | 6/1995 | Lessing, Jr. | |
| D360,073 | S | 7/1995 | Schrader et al. | |

(Continued)

FOREIGN PATENT DOCUMENTS

GB 2241880 9/1991

(Continued)

OTHER PUBLICATIONS

Office Action mailed Nov. 15, 2011 in Japanese Patent Application No. 2009-549701, plus English translation thereof. Machine translation of JP 3050475 U.

*Primary Examiner* — Justin Larson
(74) *Attorney, Agent, or Firm* — Mark E. Scott; Conley Rose, P.C.

(57) ABSTRACT

A compact yet expandable waist belt with a pouch preferably formed from a single piece of seamless elastic fabric, designed in some embodiments with pleats in the back, that remains taut around the wearer's body during even the most rigorous physical activities, whether the pouch is holding one smaller item (such as a key) or multiple larger items (such as a cell phone, mp3 player, and/or money). When empty, the pouch is preferably approximately the same width and thickness as the belt holding the pouch in place, and yet the pouch's internal volume can expand up to 300-400% or more to hold larger items or a large number of small items. The single pouch is sealed with zipper or other fasteners such as Velcro® allowing users to access belongings quickly and easily.

33 Claims, 8 Drawing Sheets

U.S. PATENT DOCUMENTS

| | | | | |
|---|---|---|---|---|
| 5,540,366 | A | 7/1996 | Coomber | |
| 5,645,205 | A | 7/1997 | Kennedy | |
| 5,671,481 | A * | 9/1997 | Giard | 2/170 |
| 5,704,531 | A * | 1/1998 | Nam | 224/676 |
| 5,862,526 | A * | 1/1999 | Longcor et al. | 2/338 |
| D409,380 | S | 5/1999 | Angus et al. | |
| 5,946,733 | A * | 9/1999 | Spooner | 2/312 |
| D419,291 | S | 1/2000 | Pugh | |
| 6,016,772 | A | 1/2000 | Noyes | |
| D453,264 | S | 2/2002 | Acevedo, Jr. | |
| D458,021 | S | 6/2002 | Willows et al. | |
| D473,048 | S | 4/2003 | DiLorenzo | |
| 6,698,636 | B2 | 3/2004 | Angus et al. | |
| D490,238 | S | 5/2004 | Bristel | |
| 6,971,562 | B2 | 12/2005 | Willows et al. | |
| D541,044 | S | 4/2007 | Wagner, II | |
| D553,853 | S | 10/2007 | Willows et al. | |
| D553,854 | S | 10/2007 | Willows et al. | |
| 2007/0138222 | A1 * | 6/2007 | Goldman | 224/401 |

FOREIGN PATENT DOCUMENTS

| | | |
|---|---|---|
| JP | 63-117314 | 7/1988 |
| JP | 3050475 | 7/1998 |

* cited by examiner

BELT WITH EXPANDABLE POUCH

This application claims priority from U.S. Provisional Application No. 60/901,815 filed on Feb. 13, 2007, and from Provisional Application No. 60/932,250 filed on May 29, 2007, both of which are incorporated herein by reference.

TECHNICAL FIELD OF THE INVENTION

The present invention relates to wearable accessories for carrying one or more items during physical activity.

BACKGROUND OF THE INVENTION

Current belts with pouches on the market offer large multi-compartment, multi-panel, and multi-dimensional pouches. Pouches are typically much larger in width, when empty, than the belt's actual width. Large pouches are cumbersome for the individual wanting to carry one to a few items such as a car key and/or cell phone. Moreover, small items tend to bounce around inside a large pouch of fixed dimensions, which can be a distraction to the wearer.

U.S. Pat. No. D334,471 to Yerby, et al. shows a waist pouch practical for day-to-day use, and carrying multiple items. This pouch, however, is not practical for the runner needing to hide his or her one key. It is also not practical for the exercise involved in rigorous activity, in that the pouch will jump around.

There are several waist pouch type designs on the market, such as U.S. Pat. No. 5,150,824 to Alvarez, et al. (Sep. 29, 1992), but similar to U.S. Pat. No. D334,471, such packs/pouches/bags are impractical for individuals who are in need of a holder for just their key, or phone, or money, and for those who are involved in rigorous activity such as jogging or exercising. The excess material for various compartments also increases the cost and time of production.

U.S. Pat. No. 5,060,835 to Payne (Oct. 29, 1991) discloses a belt type personal carrier apparatus for conveniently supporting a beverage container and other belongings of a person about the person's waist. Though this belt provides the user with a carrying space attached to the pocket, it is designed to fit atop of the belt; therefore it will bounce when the user participates in vigorous activities such as jogging. Additionally if or when the water carrying devise is not used it will interfere with the comfort of the user.

U.S. Pat. No. 5,353,975 to Libertucci (Oct. 11, 1994) is specifically designed as a Carrier For A Portable Stereo Unit. It has the capability to hold items such as an MP3 player and Internet access mobile phone, but as with U.S. Pat. No. 5,060,835 and U.S. Pat. No. D334,471 it is impractical for individuals who are in need of a holder for just their key, or phone, or money, and for those who are involved in rigorous activities such as jogging or exercising.

U.S. Pat. No. 5,645,205 to Kennedy (Jul. 8, 1997) shows a pouch, consisting of an enclosure, a re-sealable inner waterproof pouch, and a detachable strap to be fastened around the waist of the user. Users may find this useful when swimming where there is not such a need for a belt to stay snug to the body, but during out of the water rigorous activities this belt is not practical. This pouch is not designed to remain taut against the body and will not withstand rigorous activities such as jogging or exercising out of the water.

U.S. Pat. No. 6,698,636 to Angus et al. (Mar. 2, 2004) waist pouch. This is an example of a multi-pocket belt. This pouch is made with elastic that expands on the user's body, however the multi-pocket belt also comes with a thick band and bulky buckles. A thicker belt promotes sweat, and is not preferred by the runner or exercise enthusiasts who prefer to keep their apparel to a minimum.

Other waist pack/pouches multi-compartment styles on the market can make it difficult to access a single item while engaging in a rigorous activity such as jogging or exercising. Runners today, particularly marathoners, consume energy products such as Gu® while they are running. Multi-compartment belt pouches do not allow for quick access to items, and are confusing to the user when searching for a single item during an activity such as running.

SUMMARY OF THE INVENTIONS

Embodiments of the present invention solve the problem of having access to an item or items by providing a belt having an expandable pocket design with preferably a single opening to access any and all items stored.

The foregoing has outlined rather broadly the features and technical advantages of embodiments of the present invention in order that the detailed description of the invention that follows may be better understood. Additional features and advantages of the invention will be described hereinafter. It should be appreciated by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF THE PREFERRED EMBODIMENTS

Figure 1:
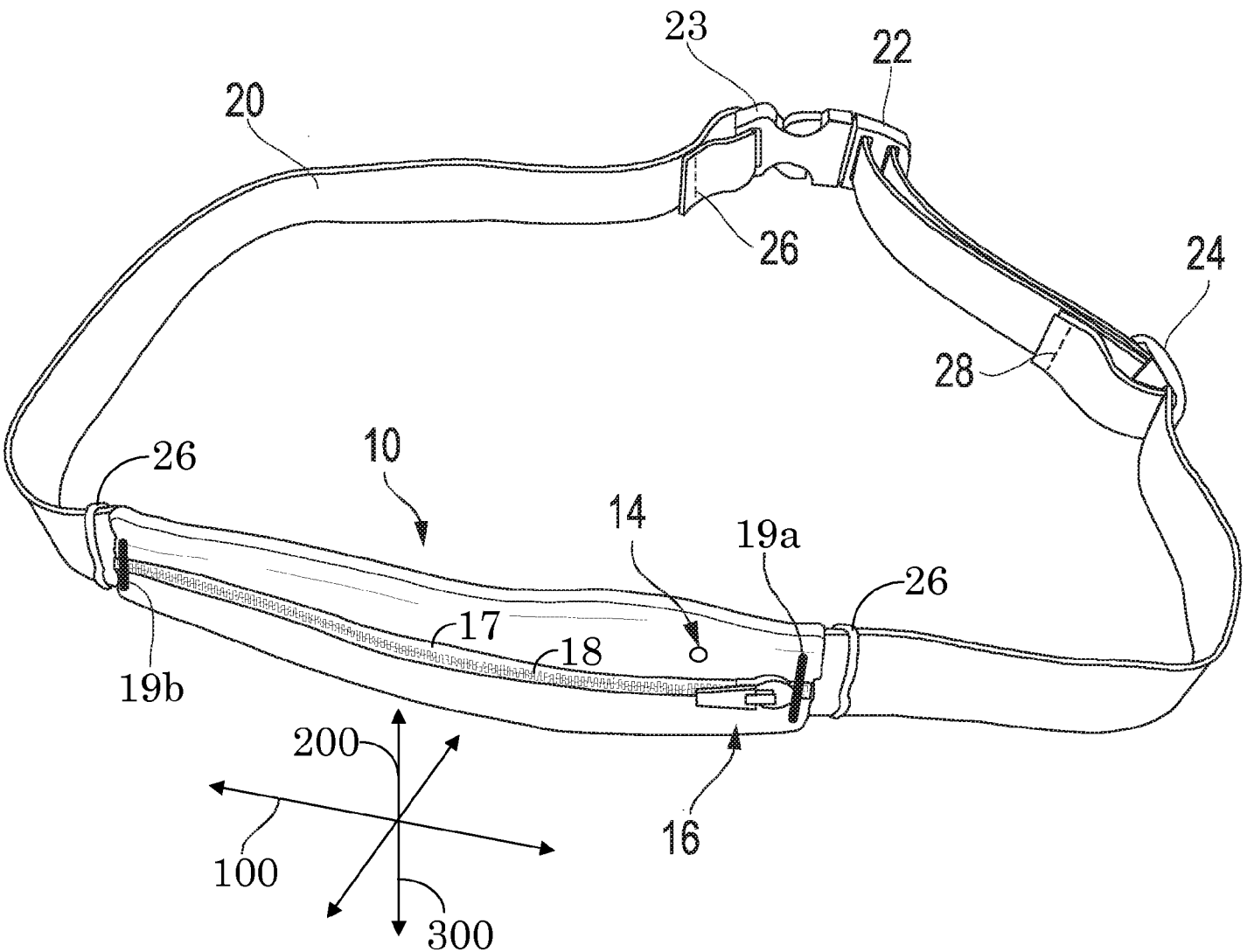
FIG. 1 is a front view of one embodiment of the present invention, showing the front of the pouch, with the belt buckles attached together.

Preferred embodiments of the present invention provide a compact yet expandable single pouch waist belt that remains taut around the wearer's body during even the most rigorous activities, whether the pouch is holding one item (such as a key) multiple items (such as multiple keys, a cell phone, mp3 player, and/or money). When empty, the pouch is preferably approximately the same width and thickness as the belt holding the pouch in place. The novel construction and design described herein allow the pouch's internal volume expand up to 300-400% or more to hold larger items or a large number of small items.

A preferred method or apparatus of the present invention has many novel aspects, and because the invention can be embodied in different methods or apparatuses for different purposes, not every aspect need be present in every embodiment. Moreover, many of the aspects of the described embodiments may be separately patentable.

In preferred embodiments of the invention, the pouch is held in place by a flexible/elastic belt or main waist strap fits snuggly around the user, typically around the user's waist. The pouch preferably forms a part of the structure of the belt, that is, the pouch carries the tension force between the ends of the belt that are on opposite sides of the pouch, as opposed to having a single belt material that extends around the user with a pouch hanging from the belt material. Other embodiments can be adapted to fit around other parts of a wearer's body, including, for example, the upper arm, wrist, thigh, or ankle.

The pouch itself is preferably formed on a one-piece, seamless, elastic/expandable fabric or other material, that is preferably approximately the same width, when empty (and thus unstretched) than the than the elastic belt supporting the pouch. When objects of sufficient size are placed in the pouch, the pouch fabric stretches to hold the items. The transverse tension placed on the items within the pouch by the stretched pouch serves to hold items in the pouch snuggly, preventing them from flopping around and distracting the wearer during physical activity. The elasticity of the pouch and size of the pouch can be varied depending on the intended use, such as the size of the items that are to be contained within the pouch and the intended activity of the wearer. Multiple pouches can be used on a single belt, either by connecting the pouches to each other or by sewing belt sections between the multiple pouches. The width of the pouch, when empty, is preferably the same as or slightly larger than the width of the belt, although in various embodiments, the pouch can be smaller, the same size, or wider than the belt.

Embodiments of the present invention solve many of the problems of prior art waist pouches. Many prior art waist pouches have too much volume within the pouch. This results in pouches that are bulky to wear, which bounce and move during physical exertion by the wearer, and do not hold stored items securely. Large pouches also make it cumbersome to hold/store only one or two relatively small items. Waist pouches with small pouches eliminate these problems, but suffer from another obvious shortcoming—they will not hold multiple and/or larger items. Although pouches made from elastic materials are also known, if those pouches hang from the support belt as in the prior art, the pouch will also bounce around during physical activity. Pouches integrated into the belt do not bounce around as much during physical activity, however these pouches are not typically elastic or expandable because it would prevent the belt from fitting snuggly.

The present design, however, provides a pouch that is expandable while being integrated with the belt and still provides a snug fit around the wearer's body. This is accomplished with the novel design of using one piece of fabric to create the pouch rather than using multiple pieces of material stitched together to create compartments, as in the prior art. The use of asymmetrically elastic fabric and/or the zipper design described below allows the pouch to stretch transversely but not stretch along the long axis of the belt. This allows the pouch to remain snug against the wearer's body during use, to hold small objects firmly and yet to expand to hold larger objects. Further, this is accomplished with a design that is economically and easily produced.

Several objects and advantages provided by various embodiments of the invention include: to provide a belt with a small expandable single pocket pouch which can be economically and easily produced; to provide a carrying belt apparatus with a small pouch with asymmetrically expanding fabric and pleats that allow the small design of the pouch to expand according to its contents; to provide a compact yet expandable single pouch waist belt that remains taut during even the most rigorous activities when holding one item (such as a key) or multiple larger items (such as multiple keys, a cell phone, an mp3 player and/or money or credit cards); to provide a single pouch waist belt that enables for easy access of items so the individual does not have to stop, look down, "fish for," dig, or disturb their physical activity to retrieve item(s); to provide a belt that is water-friendly and washable; and to provide a comfortable and secure alternative to holding items in a pocket or purse when traveling or for daily use, including for example, insulin pumps or other medical devices/treatments.

Figure 2:
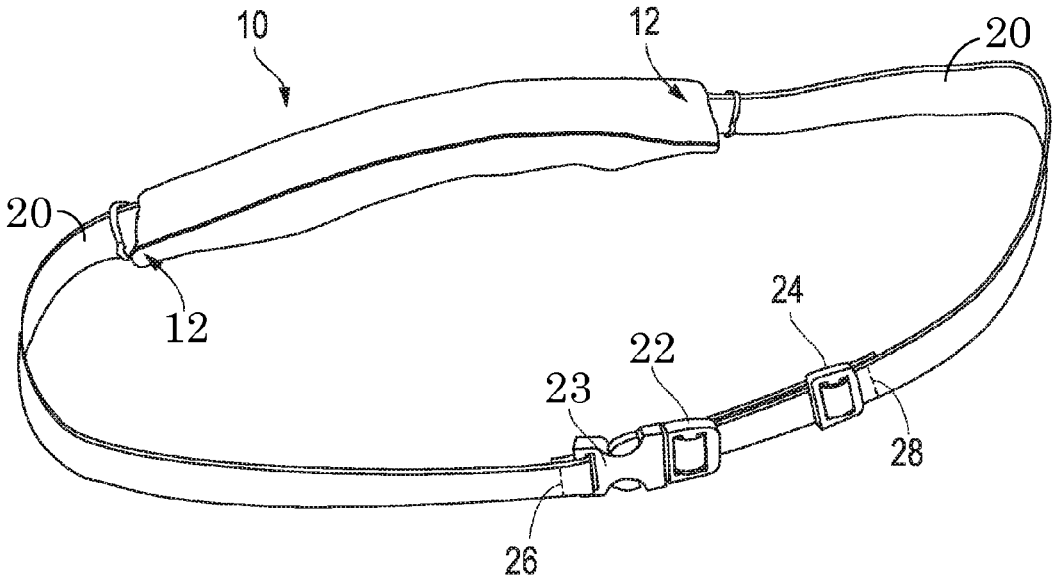
FIG. 2 is a back view of the embodiment of FIG. 1.
Figure 4:
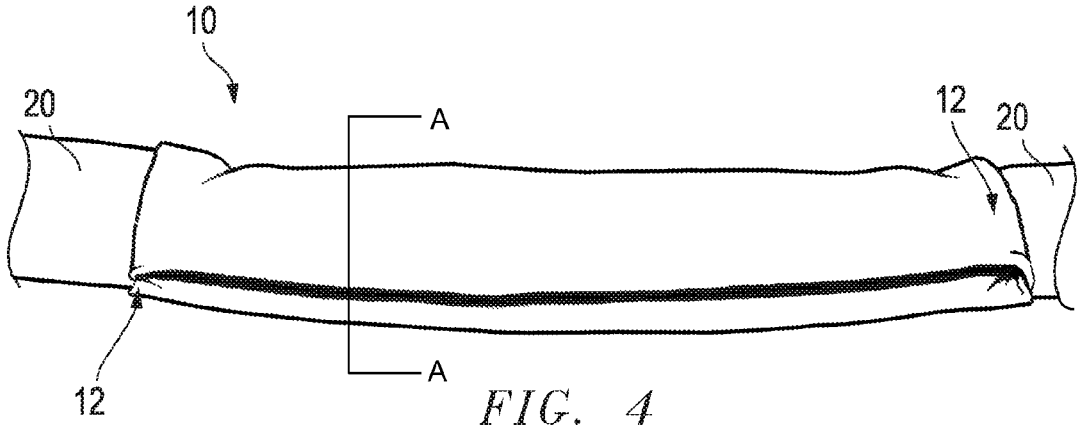
FIG. 4 is a view of the back of an empty pleated pouch according to the present invention.
Figure 7:
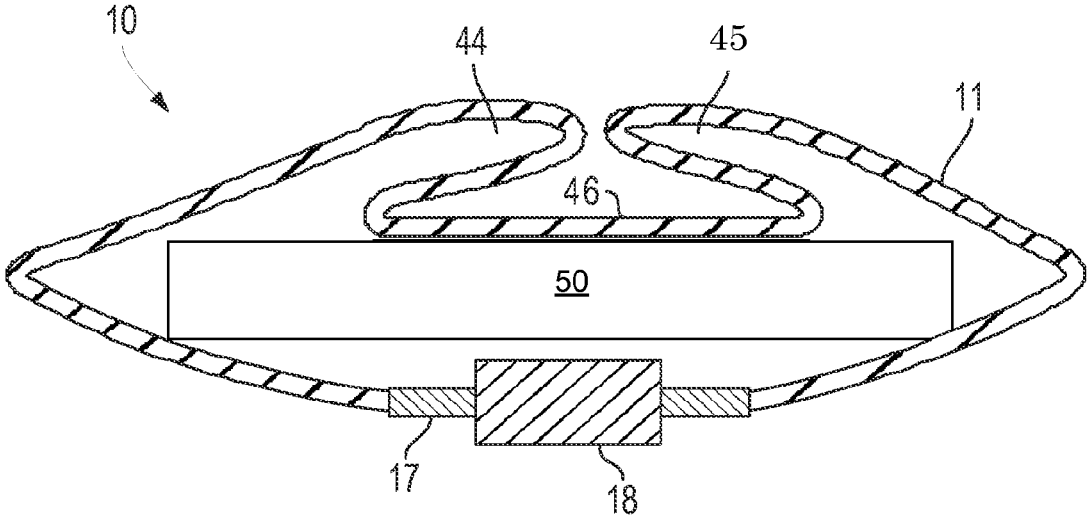
FIG. 7 shows a cross section of the pouch of FIG. 6 showing the pleats pulled apart by the item in the pouch.
Figure 9:
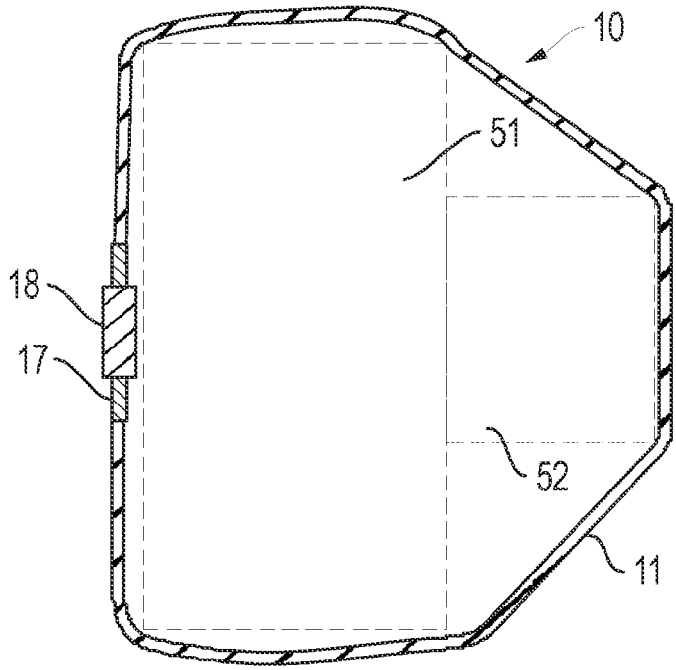
FIG. 9 shows a cross section of the pouch of FIG. 8 showing the pleats completely unfolded and the pouch material stretched by multiple items in the pouch.

A preferred embodiment of the present invention is illustrated in FIG. 1 (front/elevational view) and FIG. 2 (back/elevational view). Preferred embodiments of the present invention comprise a single pouch 10 made of a single piece of seamless pouch material 11. Referring also to FIGS. 4, 7, and 9, pouch material 11 is preferably a flexible fabric material that does not maintain a three dimensional structure when no forces are applied to the material. That is, with no items in the pouch, the pouch will flatten and collapse on itself and not hold a particular shape (although the material can be fastened to the belt using pleats as discussed below to hold the fabric in an overlapping shape when the pouch is empty). There is no preferred direction of radial expansion, that is, when placing items in the pouch, the pouch interior expands to hold the item, expanding in all transverse directions (that is, directions substantially perpendicular to the belt axis) non-preferentially. The material is preferably soft and without hard corners, such as would be found on a leather or hard plastic pack.

Pouch material 11 preferably comprises an elastic/expandable fabric or other material, such as polyester, that is preferably approximately the same width, when empty and thus unstretched, than the than the elastic belt 20 that supports the pouch, making those embodiments ideal for the individual carrying only few items. In one preferred embodiment, both the belt and the empty pouch are approximately one inch wide, although different widths may be used. In other embodiments, the pouch may be, for example, about 10-50% wider, when empty, than the belt.

The pouch 10 is preferably made from one piece of generally rectangular or square fabric measuring in thickness of 0.1 millimeter to 1.6 millimeters. A thin fabric allows the user to operate the controls of MP3 players or other personal electronic devices through the pouch 10 without having to disrupt activity and/or open zipper 16. The fabric forming the pouch is also preferably very elastic and capable of stretching up to 250% or more without rupture of the overall material (although individual filaments, layers or bonds may break without rupturing the overall material). For example, a suitable flexible fabric would be 80% NYLON, 20% LYCRA Tricot fabric. Suitable fabrics are available, for example, from B.N.B International Textiles of Los Angeles, Calif.

The pouch itself can be easily constructed from one seamless piece of material. For example, a generally rectangular piece of fabric can be folded over (so that the top edge is brought to the bottom edges) to enclose an internal volume. Persons of ordinary skill will recognize that different shaped fabric pieces can be used to achieve the same purpose. The sides can be gathered around the proximal ends (toward the pouch and away from the buckles) of the belt sections and stitched or otherwise attached. As discussed below, the fabric/material on the back of the pouch can be overlapped before stitching to form pleats. Once the pouch ends have been secured, the top and bottom edges can be fitted with an appropriate fastener such as a zipper stitched along the top and bottom edges to allow the pouch to be securely closed.

The construction of a preferred pouch of the current invention, made from a single piece of fabric, is far less expensive and easier to reproduce than prior art pouches with multiple compartments, panels, and dimensional pouches. Other belts with multi-compartments and panels require more time to produce, more fabric and more closing apparatuses such as Velcro® and zippers, etc.

A preferred embodiment's single fabric piece pouch construction also serves a purpose in improving the expandability of the pouch. The pouches in prior art waist pouches are typically formed from multiple pieces of material stitched or otherwise attached together. The seams are typically much less elastic than the pouch fabric. In order to hold firmly, the thread used to create such seams is typically non-elastic. As a result, the seams in the pouch material will not stretch and tend to limit the elasticity of the pouch itself.

Figure 11:
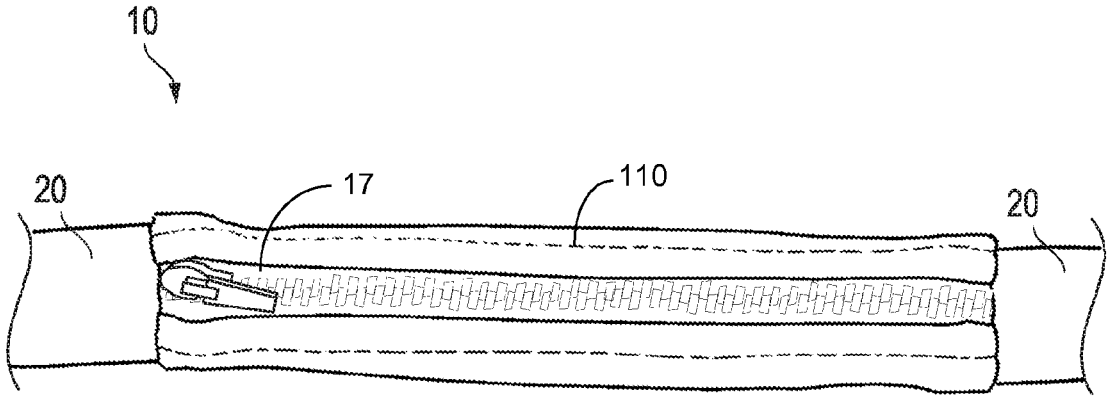
FIG. 11 is a front view of an empty pouch according to the present invention.
Figure 12:
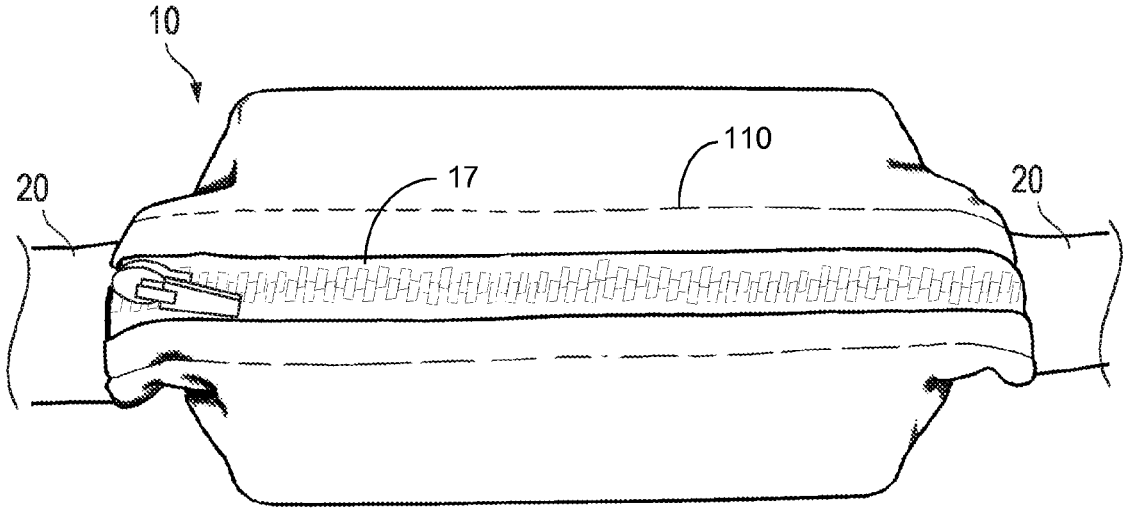
FIG. 12 is a front view of a full pouch according to the present invention.

By using a one-piece construction, the pouch of the present invention can be virtually the same size as the belt when empty, but can still expand to hold larger items. A pouch according to the present invention is preferably "seamless." Of course, persons of ordinary skill will recognize that there may be seams joining the top and bottom edges of the one-piece pouch material to, for example, by stitches 110 on either side of the zipper tape 17 as shown in FIGS. 11-12 and discussed below. By "seamless," Applicants mean that the pouch is formed from essentially one continuous piece of material with the only seams being at the sides (where the pouch material is connected to the belt) and at the opening to the pouch. This type of one-piece construction is also typically cheaper and easier to manufacture than the prior art multi-piece pouches with seams. In some embodiments it may also be desirable to "stitch" or otherwise fasten a label inside the pouch. This will not serve to significantly limit the expansion of the pouch, and would not prevent a pouch from being described as "seamless" as Applicant has defined the word.

A single fabric pouch design used in some preferred embodiments also makes it easier to provide/manufacture pouches in various colors and patterns. It is not necessary to coordinate the colors/designs of different seam threads or varying pouch materials. This allows production to more easily incorporate a variety of colors at low cost to production. Other belts and their pouches are available only in black, with little to no variation in material color or style. As running and fitness have become more popular, individuals have been given a variety in choices of designs for their apparel and shoes. A belt with single fabric pouch is able to offer individuals with a variety of pouch appearances (colors, designs, fabric types, etc.) at a relatively low production cost where prior-art pouches do not.

In some embodiments, the pouch will also have asymmetric elasticity, that is, the pouch will be able to be more-readily stretched in directions transverse to the long axis of the belt than along the long axis. Lower elasticity in the long direction of the belt allows the pouch to carry the tension of the belt between separated belt portions and maintain a snug fit on the user, while the increased elasticity in the transverse direction allows the pouch to more easily expand in directions transverse to the long axis, so that the pouch can easily expand to hold one or more items. Without such a limit on longitudinal elasticity, a pouch which is continuous with the belt (as is the present invention) would itself be stretched as the belt is tightened around a wearer's body. This would result in less available expansion capability for the pouch since it would be pre-stretched. The resulting increased tension in the pouch would also make it more difficult to add or remove items.

In some embodiments, the fabric or other material used to form the pouch will be an asymmetrically expandable material and be arranged so that the fabric/material will be substantially non-elastic in a longitudinal direction (along the axis 100 of the belt) but be substantially more elastic radially or transverse to the belt axis (for example in directions 200 and 300). Preferred fabrics/materials can be made from, for example, polyester or other similar materials. The phrases "asymmetrically expandable material," asymmetrically elastic," and "one-way stretch" are used to refer to a fabric or other material that is more elastic in one direction than in another. In other words, the fabric or other material can be stretched to a greater degree without rupture of the overall material in the first direction than in the second direction (the second direction being roughly perpendicular to the first direction).

As used herein, the term "longitudinal direction" is defined with respect to the belt/pouch laid out flat with the belt connectors unfastened. The longitudinal direction is any direction of stretch that can be represented by a straight line passing through the central region, and at least a portion of both end regions (the location of the belt connections discussed below) of the belt/pouch. By transverse to the belt is meant in any direction in a plane that is substantially perpendicular to the long axis of the belt. That is, a preferred pouch can expand radially about the belt axis.

In a preferred embodiment of the present invention, the pouch is constructed of a one-way stretchable fabric or material that allows significant flexibility in only the transverse direction. Pouch material 11 will not stretch to a significant degree along the axis of the belt but will be much more elastic radial to or transverse to the axis of the belt 20. Referring to FIG. 1, the pouch 10 will be capable of expanding to become wider and deeper (by stretching in the directions shown by arrows 200 and 300), but will not stretch to become longer (in the longitudinal direction shown by arrow 100). Asymmetrically stretching fabrics are known and used, for example, in making sails, swimwear, foundation garments, and activewear.

The pouch elasticity can also be restricted longitudinally by the incorporation of a non-stretchable seam or support, such as a zipper or similar fastener, into the front of the pouch. As shown in FIG. 1 (described in greater detail below) the zipper tape 17 (the reinforcing material outside the zipper teeth 18) is attached to the ends of the belt 20. Preferably, the attachment is by way of stitching on the inside of the pouch (not shown). Because the zipper tape 17 is not substantially elastic in the longitudinal direction, the fit of the belt 20 will be snug and will not loosen as the pouch material 11 stretches. Stitch tacks 19*a*/19*b* act as a safety, stopping zipper 16 from reaching end or start of zipper teeth 18, thus decreasing wear and tear of the pouch 10 material when zipper 16 is opened and closed over and over again.

Persons of ordinary skill in the art will recognize that a seam or other type of support, such as an insert of non-stretchable fabric or other material, could accomplish the same restriction of longitudinal elasticity of the pouch. In some embodiments, the pouch fabric itself may be elastic in longitudinal direction, but the zipper (or similar supporting structure) will prevent the fit of the belt around the user's waist from loosening as the pouch material stretches. Where this type of longitudinal support is used, symmetrically elastic material, such as spandex or a spandex blend, may be used to form the pouch. In that case the pouch material may be stretchable in the longitudinal direction, but the longitudinal stretching of the pouch itself (where it connects to the two ends of the belt) is still restricted.

Figure 5:
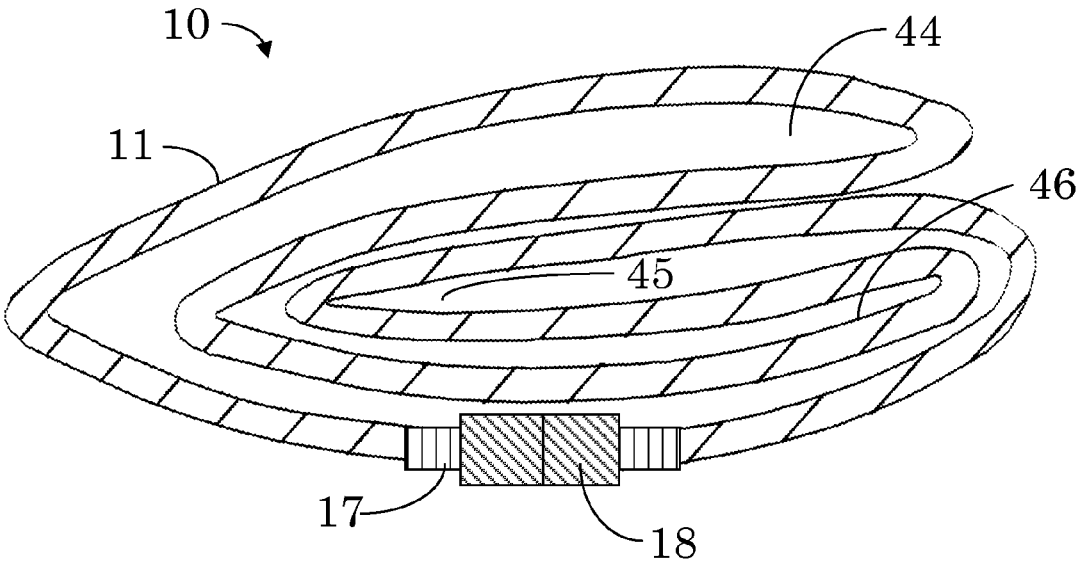
FIG. 5 shows a cross section of the pouch of FIG. 4 showing the overlap of the pleated pouch material.

In a preferred embodiment of the present invention, the material 11 forming the pouch 10 can also be pleated to allow greater expandability of the pouch. For example, pleats 12 used in the back of the pouch as shown in FIGS. 4, 5, 6, and 7 allow more fabric or other material to be used for the pouch while still allowing the pouch to compress/collapse to a small size when empty. Preferably, an empty pouch will be substantially the same width as the belt. When empty, the folds of material, created by the pleats, cause the material to overlap as shown in FIG. 5. When a larger object is placed in the pouch, however, the material can unfold (especially in the center of the pouch) to hold the larger object.

The pleats, along with the other novel features discussed above, allows an empty pouch to be relatively small and unobtrusive, for example only slightly wider than the belt itself, while still allowing the pouch to expand to hold larger items. Lower elasticity along the belt axis means the belt will still fit snuggly around wearer's body. The small size of pouch relative to belt means that the belt will be more comfortable when no or only small items are carried and to be more aesthetically pleasing. Further, the relatively small size of the pouch and the tension force (exerted by the elastic material) which holds items firmly makes the pouch of the present invention much less distracting and/or interfering to a user during physical activity than pouches known in the prior art.

The pouch is held in place by a flexible/elastic belt or main waist strap fits snuggly around the user, typically around the user's waist. To maintain a snug fit while allowing motion of the user, the belt is preferably made of a longitudinally elastic material that expands in the long direction, and contracts in tension to hold the belt snuggly on the user. The main waist strap is preferably made from stretchy/soft material like the breathable nylon stretch material used in suspender straps, stretch waistbands and the like, but also many other materials can be used (any material that can be suitably formed/cut into a strap can obviously be used).

In the embodiments shown in FIGS. 1 and 2, male buckle 22 and female buckle 23 when attached together hold the right and left portion of belt 20 together around the wearer's body. Various types of buckles or fasteners can be used, including those with reflectors, center release, contour or non-contour, with single or double adjustments, various colors and sizes, etc. In the illustrated embodiment, male buckle 22 with double loop adjustment is preferably attached to the belt 20 after tri-glide 24 is attached and sewn with a stitch 28. Female buckle 23, with or without a double loop, is preferably attached by a stitch near (as close to) the female buckle 23 with a stitch 26.

Preferably, a tri-glide slide 24 allows adjustment to the size of the elastic belt 20 to create a custom and tight fit. In some embodiments, tri-glide slides 24 can be placed on both sides of the elastic belt 20 for double adjustability.

In the embodiment shown in FIGS. 1 and 2, belt 20 comprises two lengths of elastic material; one threaded through tri-glide 24 and through the adjustable loop on male buckle 22 and the other attached to female buckle 23. To prevent fraying of the end of the elastic belt 20, the stitches 26 and 28 is made after folding the belt material over (doubling the elastic material by up to 8 mm). Where buckles having double adjustability are used, stitch 28 will be made on both sides of the portion of belt 20 that has been threaded through and stitch 26 will not be needed. Optional grommet ring 14 allows for headphones attached to electronic device or devices in the pouch 10 to thread through pouch 10 while still allowing zipper 16 to fully close.

Figure 3:
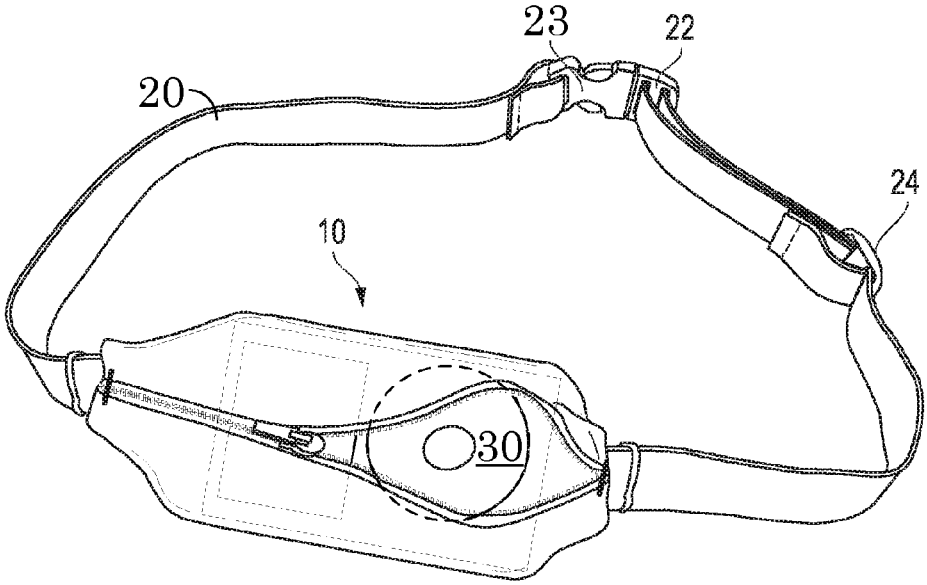
FIG. 3 shows the waist pouch of FIG. 1 with the zipper partially open and with an MP3 player in the pouch.
Figure 8:
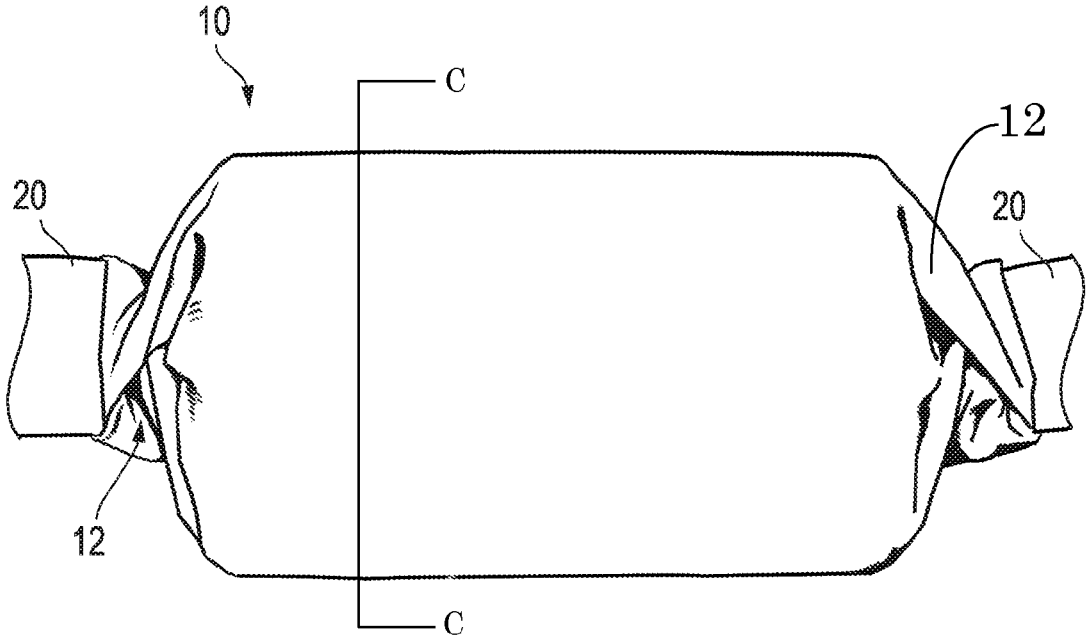
FIG. 8 is a view of the back of a full pleated pouch according to the present invention.

FIG. 3 shows a preferred embodiment of the present invention with a relatively large item (in this case an MP3 player 30) inside pouch 10. Referring also to FIGS. 8-9, the pouch material 11 has stretched/expanded radially about the belt axis, but has not stretched in length. As a result, the pouch inner volume has expanded to hold the larger object, but the fit of the belt around the wearer's body remains snug.

Elastic belts 20 can be attached to pouch 10 using any suitable means. For example, a producer and/or manufacturer of the belt can turn pouch 10 inside-out and attach each end of the pouch material to the elastic belt by a stitch that joins the pouch material completely around the belt. The same stitching can also hold the ends of zipper 16 in place. As discussed above, stitching the relatively non-elastic zipper 16 to the ends of belt 20 also serves to restrict the longitudinal elasticity of the pouch.

FIG. 4 shows the back (the side toward the wearer's body) of an empty pleated pouch 10 according to a preferred embodiment of the present invention. Pleats 12 are formed in the pouch material 11 to allow the pouch 10 greater expandability, while still maintaining a small profile when empty. In order to create the pleats 12 that allow the pouch 10 to expand in width according to the pouch's 10 contents, the producer and/or manufacturer will then pinch in, overlap, or layer the material 11 longitudinally at the right and left edges of the pouch and then stitch or otherwise attach the pleated fabric to the ends of belt 20.

Figure 6:
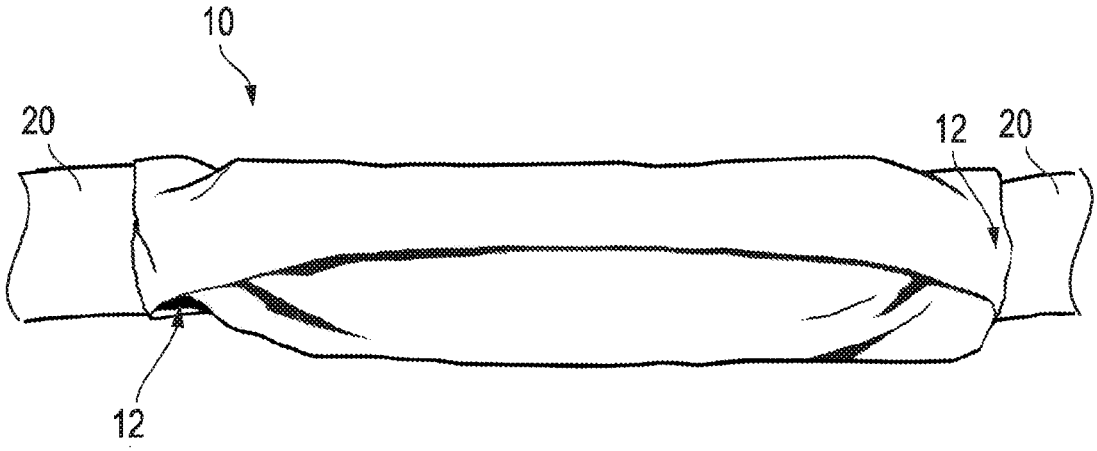
FIG. 6 is a view of the back of a pleated pouch according to the present invention that contains a relatively small item.

FIG. 5 shows a cross-section of the pouch of FIG. 4 along line A-A. When the pouch is empty, the pleats 12 at the side of the pouch will cause the material folds 44 to overlap the underlying pouch material 46, even in the center of the pouch (along line AA). FIG. 6 shows the back (the side toward the wearer's body) of a pleated pouch 10 with a relatively small item placed in the pouch. FIG. 7 shows a cross-section of a pleated pouch 10 with a relatively small item (not shown) placed inside the pouch. As shown in FIG. 6, the pouch material has started to unfold or straightened out to accommodate the object placed in the pouch, although the outer fold 44 is still folded over inner fold 45. In FIG. 7, a somewhat larger object 50 has been placed in the pouch. This item has pushed on the pouch material so that the pleats 44 and 45 are no longer overlapping. FIG. 8 shows the back of a pleated pouch 10 with multiple larger items placed in the pouch. FIG. 9 shows a cross-section of the pouch of FIG. 8 along line B-B with objects 51 and 52 placed inside pouch 10. As shown in FIG. 9, the pouch material 11 has stretched radially to accommodate objects 51 and 52.

Preferably, as shown in FIG. 1, the front of the pouch 10 does not have pleats 12 and will remain smooth. When the back of the pouch 10 as shown in FIG. 2 is layered, overlapped, or "pinched-in" to create the pleats 12, preferably the overlapping only happens at the back of the belt as shown in FIG. 4 for a more aesthetically pleasing appearance.

Embodiments of the pouch of current invention can also be designed for underwater use, for example, by using waterproof pouch material and a watertight closure, such as a watertight zipper. Such embodiments would offer users a place to carry items such as personal identification or a key in the water and to continue wearing the belt outside of the water. The single pocket of the present invention gives the user easy access to their items.

Preferred embodiments of the present invention can also include multiple pouches of the same or different sizes and elasticities. For example, two separate pouches can be on the same belt, either attached together or with a length of belt between them. A user can place individual items in separate pouches to allow easy access and location of a desired object during physical activity. For example, a smaller pouch could be used for holding a key and a larger pouch for holding an energy bar or MP3 player.

Embodiments of the pouch of current invention can also be formed from an elastic material with a high degree of light reflectivity. Preferably, the pouch is formed from material that is retroreflective and thus reflects light back at a light source, such as car headlights. Although many prior art waist belts use some type of reflective strip to increase the wearer's night-time visibility, these reflective strips are typically small compared to the overall pouch/belt size. Also, these strips are typically not elastic and thus tend to restrict the expandability of the prior art pouches. The present invention, however, can use a pouch made entirely from an elastic retroreflective material for increased visibility without sacrificing the other desirable feature of the invention as described herein. A suitable retroreflective stretch fabric is available, for example, from JRC Reflex of Roman, France. In some embodiments, the elastic belt sections can also be formed from an elastic material that is retroreflective or has retroreflective material components.

Figure 10:
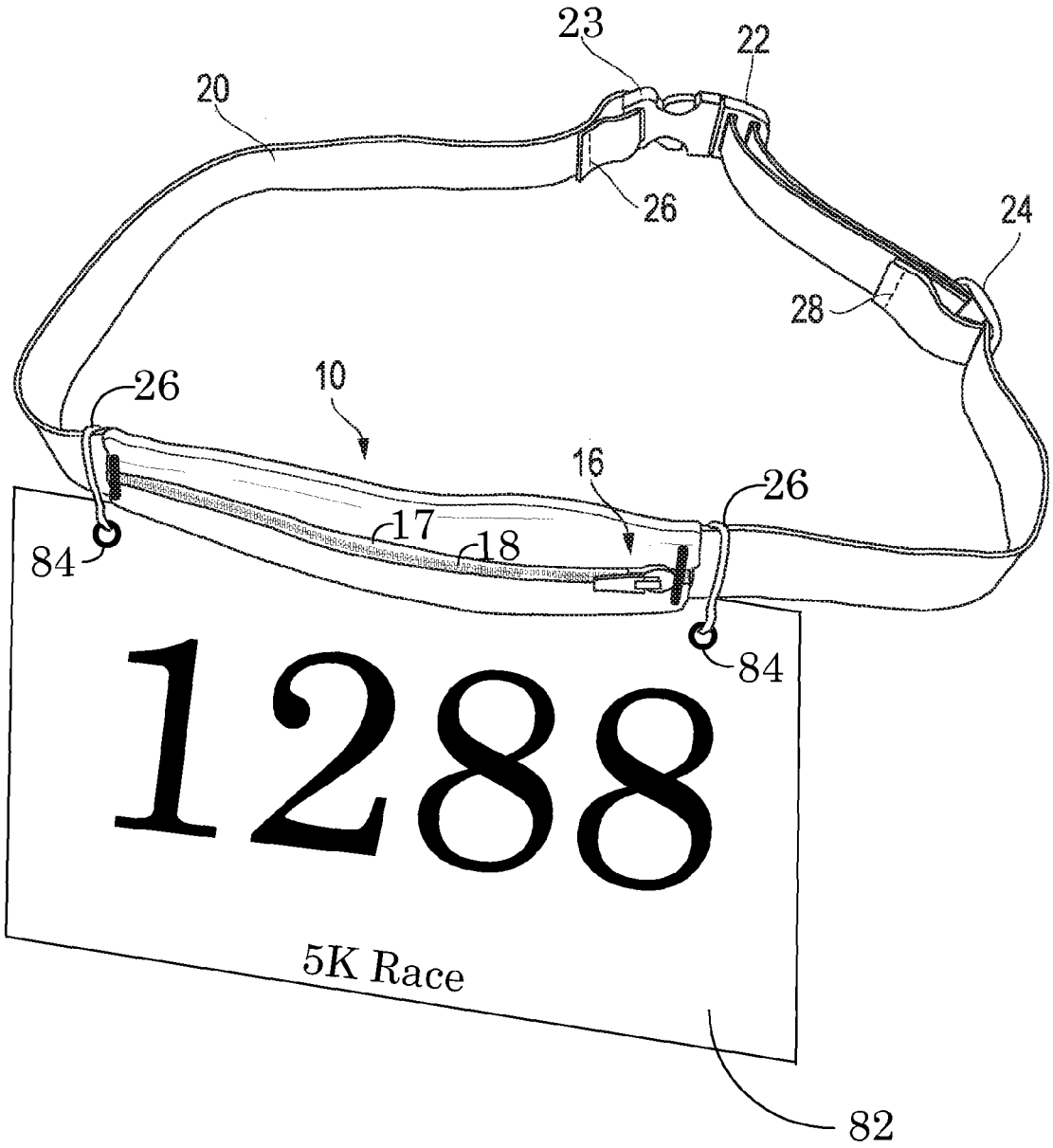
FIG. 10 a front view of one embodiment of the present invention, showing the front of the pouch, with the belt buckles attached together and with snap hooks around the belt used to mount a runner's race number.

Some embodiments include buttons, hooks or other mechanism for mounting a race number. FIG. 10 shows the belt passing through two standard snap hooks 26, one on either side of the pouch 10. The hooks can be attached to holes 84 in the upper right and left corners of a race number 82 to suspend the number from the pouch belt 20. Alternatively, any other suitable fasteners can be used, including, for example, snaps, conventional buttons, or Velcro™ fasteners. One component of each fastener can be permanently fixed to the belt, typically with one component on either side of the pouch. The race number 82 could then be positioned over the fixed button, and the second, mating components of the snap buttons are snapped onto the snaps mounted on the belt.

Figure 13:
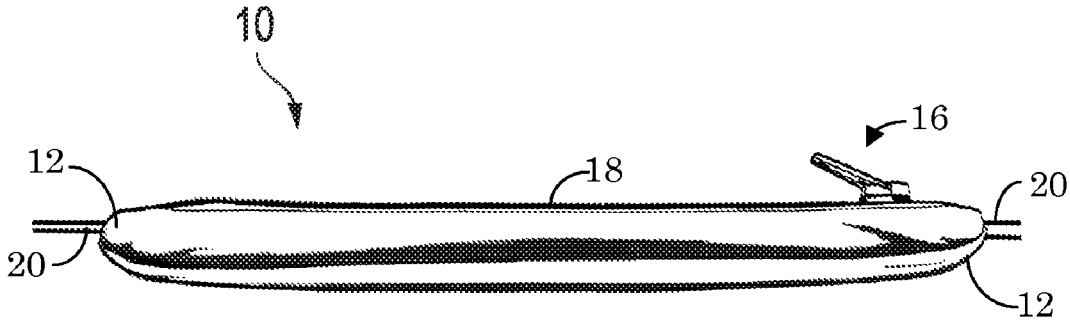
FIG. 13 is a top down view of an empty pouch according to the present invention.
Figure 14:
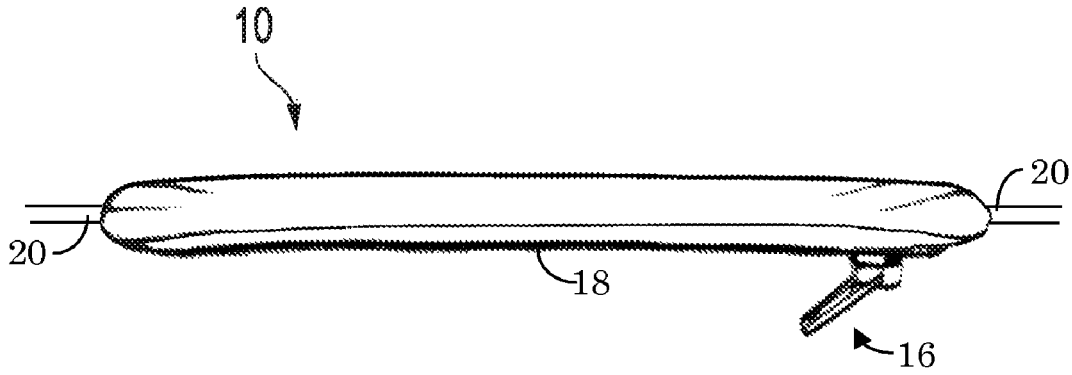
FIG. 14 is a bottom up view of an empty pouch according to the present invention.

FIGS. 11 and 12 show front views of the pouch alone, when empty and when full; while FIGS. 13 and 14 show top and bottom views of the empty pouch of FIG. 11.

The present invention has broad applicability and can provide many benefits as described and shown in the examples above. The embodiments will vary greatly depending upon the specific application, and not every embodiment will provide all of the benefits and meet all of the objectives that are achievable by the invention. The accompanying drawings are intended to aid in understanding the present invention and, unless otherwise indicated, are not drawn to scale.

The scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. Further, unless specifically noted, the drawings are

We claim as follows:

1. A wearable apparatus for storing items comprising a belt including first and second ends and an expandable pouch that defines an internal volume, the pouch comprising a piece of material having first and second ends, said first and second belt ends being attached to said first and second pouch ends, respectively, said pouch comprising first and second folds spaced apart by a section of said pouch material, said first fold and said pouch material section forming a recess into which said second fold is received when said pouch is in a substantially non-expanded condition, wherein said recess is external to said internal volume.

2. The apparatus of claim 1 wherein said first fold extends from said first pouch end to said second pouch end in a substantially longitudinal direction.

3. The apparatus of claim 1 wherein said pouch material is elastic and further comprising a substantially non-stretchable part extending from said first end of said pouch to said second end of said pouch so as to prevent said pouch material from stretching substantially in said substantially longitudinal direction.

4. The apparatus of claim 1 wherein said pouch material is a single seamless piece of elastic material which expands to conform to the contours of an enclosed object.

5. The apparatus of claim 1 wherein said belt has a longitudinal axis and said pouch material is a one-way stretchable material that is more elastic in a direction transverse to said longitudinal axis of the belt than in a direction parallel to said longitudinal axis of said belt.

6. The apparatus of claim 1 wherein said belt has a longitudinal axis and said pouch has greater expandability in a direction transverse to said longitudinal axis of said belt than in the direction parallel to said longitudinal axis of said belt, the asymmetric expandability allowing the pouch to expand in a direction transverse to said longitudinal axis to firmly hold items, while allowing the belt to be maintained firmly on the wearer.

7. The wearable apparatus of claim 1 wherein said folds allow the pouch to expand in the transverse direction when an object is received within the pouch.

8. A method for forming a wearable apparatus for storing items, the method comprising the steps of: forming a belt with first and second ends; folding a piece of elastic material to form a pouch having first and second opposite ends; gathering each of said ends of the pouch around a different end of said belt; forming first and second folds spaced apart by a section of the pouch material, the first fold and the pouch material section forming a recess into which the second fold is received when the pouch is in a substantially non-expanded condition; and attaching the gathered ends of the pouch to the different ends of the belt.

9. The method of claim 8 wherein the folds allow the pouch to expand in the transverse direction when an object is received within the pouch.

10. The method of claim 8 wherein the first fold extends from the first pouch edge to the second pouch edge in a substantially longitudinal direction.

11. The method of claim 10 further comprising the steps of forming a part of substantially non-stretchable material; attaching the substantially non-stretchable material part to the pouch such that the part extends substantially from the first end of the pouch to the second end of the pouch in a substantially longitudinal direction, so as to prevent the elastic material of the pouch from stretching substantially in the substantially longitudinal direction.

12. The method of claim 10 wherein the elastic material is a single seamless piece of elastic material so as to conform to the contours of an enclosed object.

13. The method of claim 10 wherein the belt has a longitudinal axis and the elastic material is a one-way stretchable material that is more elastic in a direction transverse to the longitudinal axis of the belt than in a direction parallel to the longitudinal axis of the belt.

14. The method of claim 10 wherein the belt has a longitudinal axis and the step of forming the pouch comprises the step of forming the pouch to have greater expandability in a direction transverse to the longitudinal axis of the belt than in the direction parallel to the longitudinal axis of the belt, the asymmetric expandability allowing the pouch to expand in a direction transverse to the longitudinal axis to firmly hold items, while allowing the belt to be maintained firmly on the wearer.

15. A method of forming a wearable apparatus for storing items, the method comprising:

providing a belt of a first elastic material, the belt including first and second sections, the first and second sections including longitudinal axes, and each belt section having a distal end with fasteners so that the distal ends of said first and second sections can be releasably fastened together, and each section having proximal ends that are not attached together; and characterized by:

forming a pouch from a seamless piece of a second elastic material generally rectangular in shape, said piece of second elastic material having a top edge, a bottom edge, and side edges, wherein said pouch is formed by (i) folding the piece of second elastic material to bring the top and bottom edges together so as to enclose an inner volume, (ii) forming first and second folds spaced apart by a section of the pouch material, the first fold and the pouch material section forming a recess into which the second fold is received when the pouch is in a substantially non-expanded condition, (iii) gathering each side edge together around the proximal end of each belt section and attaching the gathered section to the proximal ends of the belt sections to that the enclosed inner volume is sealed to either side of the pouch, (iv) providing a fastener of substantially non-stretchable material, and (v) attaching said fastener to the top and bottom edges of said elastic second material so as to releasably connect said edges together to fully enclosed the inner volume of the pouch.

16. The method of claim 15 wherein the folds allow the pouch to expand in the transverse direction when an object is received within the pouch.

17. A wearable apparatus for storing items comprising a belt including first and second ends and an expandable pouch comprising a piece of elastic material having first and second ends, said first and second belt ends being attached to said first and second pouch ends, respectively, said pouch comprising a substantially non-stretchable part extending from said first end of said pouch to said second end of said pouch in a substantially longitudinal direction so as to prevent said pouch material from stretching substantially in said substantially longitudinal direction and first and second folds spaced apart by a section of said pouch material, said first fold and said pouch material section forming a recess into which said second fold is received when the pouch is in a substantially non-expanded condition but which allow said pouch to expand in a substantially transverse direction.

18. The apparatus of claim 17 wherein pouch material comprises a single seamless piece of elastic material so as to conform to the contours of an enclosed object.

19. The wearable apparatus of claim 17 wherein said belt has a longitudinal axis and said pouch material is a one-way stretchable material that is more elastic in a direction transverse to said longitudinal axis of said belt than in a direction parallel to said longitudinal axis of said belt.

20. The apparatus of claim 17 wherein said belt has a longitudinal axis and said pouch has greater expandability in a direction transverse to said longitudinal axis of said belt than in the direction parallel to said longitudinal axis of said belt, the asymmetric expandability allowing the pouch to expand in a direction transverse to said longitudinal axis to firmly hold items, while allowing the belt to be maintained firmly on the wearer.

21. The wearable apparatus of claim 17 wherein said folds allow the pouch to expand in the transverse direction when an object is received within the pouch.

22. The apparatus of claim 17 wherein said part comprises a fastener.

23. The apparatus of claim 22 wherein said fastener comprises a zipper.

24. The apparatus of claim 22 wherein said fastener comprises a hook and loop fastener.

25. The apparatus of claim 17 wherein said piece of material comprises first and second edges and wherein said part is attached to said first and second edges of the material piece.

26. The apparatus of claim 25 wherein said part comprises a fastener.

27. The apparatus of claim 26 wherein said fastener comprises a zipper.

28. The apparatus of claim 26 wherein said fastener comprises a hook and loop fastener.

29. A method for forming a wearable apparatus for storing items, the method comprising the steps of: forming a belt with first and second ends; folding a piece of material to form a pouch having first and second opposite ends, the pouch being substantially non-stretchable in the longitudinal direction; attaching each end of the belt to a different end of the pouch forming first and second folds spaced apart by a section of the pouch material, the first fold and the pouch material section forming a recess into which the second fold is received when the pouch is in a substantially non-expanded condition, the folds allowing the pouch to expand in a transverse direction when an object is received therein.

30. The method of claim 29 wherein the material is a single seamless piece of elastic material so as to conform to the contours of an enclosed object.

31. The method of claim 29 wherein the belt has a longitudinal axis and the material is a one-way stretchable material that is more elastic in a direction transverse to the longitudinal axis of the belt than in a direction parallel to the longitudinal axis of the belt.

32. The apparatus of claim 29 wherein the belt has a longitudinal axis and the pouch has greater expandability in a direction transverse to the longitudinal axis of the belt than in the direction parallel to the longitudinal axis of the belt, the asymmetric expandability allowing the pouch to expand in a direction transverse to the longitudinal axis of the belt to firmly hold items, while allowing the belt to be maintained firmly on the wearer.

33. The wearable apparatus of claim 29 wherein said folds allow the pouch to expand in the transverse direction when an object is received within the pouch.

* * * * *